United States Patent [19]

White et al.

[11] Patent Number: 4,671,064

[45] Date of Patent: Jun. 9, 1987

[54] HEATER HEAD FOR STIRLING ENGINE

[75] Inventors: Maurice A. White, Kennewick; Stuart G. Emigh, Richland, both of Wash.

[73] Assignee: Stirling Engine Associates, Richland, Wash.

[21] Appl. No.: 677,215

[22] Filed: Nov. 30, 1984

Related U.S. Application Data

[63] Continuation-in-part of Ser. No. 519,006, Aug. 1, 1983, abandoned, which is a continuation of Ser. No. 211,432, Nov. 28, 1980, abandoned.

[51] Int. Cl.[4] ..... F02G 1/55

[52] U.S. Cl. ..... 60/517; 165/47; 165/906; 165/104.26

[58] Field of Search ..... 60/517, 524; 165/47, 165/906

[56] References Cited

U.S. PATENT DOCUMENTS

| | | | |
|---|---|---|---|
| 3,717,993 | 4/1973 | Potter | 60/517 |
| 4,016,720 | 4/1977 | Meijer | 60/524 |
| 4,055,953 | 11/1977 | Nederlof | 60/517 |
| 4,077,215 | 3/1978 | Reams et al. | 60/517 |

*Primary Examiner*—Albert W. Davis, Jr.
*Attorney, Agent, or Firm*—Don R. Mollick

[57] ABSTRACT

A heat exchanger having annular construction for a constant operation at high temperatures and pressures. A series of heating walls at high temperature surround the fluid to which heat is desired to be transferred in annular spaces. Counterbalancing pressures in areas filled with high pressure fluid and insulating gases allow use of thinwall construction for the heating walls to reduce cost and increase heat transfer. Spacers that are placed under compression are provided to maintain dimensional stability and transmit forces. Embodiments describing the use of the device as a heater or cooler and operation in either direction are illustrated. A second embodiment illustrates a heater with single sided heating of the fluid desired to be heated.

12 Claims, 6 Drawing Figures

HEATER HEAD FOR STIRLING ENGINE

This application is a continuation-in-part of application Ser. No. 519,006, filed Aug. 1, 1983, now abandoned, which is a continuation of application Ser. No. 211,432, filed Nov. 28, 1980, now abandoned.

BACKGROUND OF THE INVENTION

1. Field of the Invention

This invention relates to devices that are intended to transfer heat from one fluid to another, particularly such devices that are suitable for use in hot gas engines.

2. Description of the Prior Art

Heat is frequently needed to be added to, or extracted from a stream of moving fluid. This is commonly done by heat exchangers which transfer heat between two streams of moving fluid. A common example is in Stirling or hot-gas engines which require three heat exchangers called a heater, cooler and regenerator. The regenerator is a special type of heat exchanger with heat storage capability, and will not be discussed further. Heaters and coolers have design requirements which apply to other types of heat exchangers and include: High efficiency of transfer; controlled resistance to flow of fluid; capability to resist high temperatures and pressures; and, low cost of construction.

Several types of heater exchangers have been developed to accomplish the above design criteria. The methods can be characterized as cylinder heating, finned heat exchangers, tubular heat exchangers, baffle arrangements, and combinations of the above. Additionally, heat pipes have been used with each of the above structures. Construction of a suitable heater has, nonetheless, been one of the primary obstacles to widespread adoption of Stirling or hot gas engines.

The simplest method used is aiming a burner or other heat source at the cylinder of the engine. This method is used with small engines for demonstration purposes. This method has the advantage of low cost and simplicity, but the efficiency of heat transfer is low and the method cannot be scaled up for use in larger engines.

A variation of the above method is accomplished by adding fins to the cylinder to make a finned heat exchanger. This method can also be accomplished by adding a separate finned heat exchanger. The fins add to the efficiency of heat transfer by increasing the area exposed to heat. On the negative side, the addition of fins adds to the cost of construction as they must be welded or brazed to the cylinder or heat exchanger to operate at high temperature. The fins do not affect the pressure handling capability of the device where there is still a trade-off between thin walls for efficient transfer and thick walls for pressure resistance. As a result of the above factors, fins are generally only used in small engines.

The next most common approach has been the addition of a tubular heat exchanger. A tubular heat exchanger usually consists of a series of bent tubes running between the cylinder and regenerator. The tubes are arranged to be exposed to a burner or other heat source. To achieve high thermal efficiency, the tubes should have thin walls. Thin walled tubing, however, is limited in its pressure handling capability. Additionally, the numerous small tubes must be assembled and joined to the cylinder increasing the cost of construction. Nonetheless, tubular heat exchangers are the type most commonly used for larger engines.

Combinations of the above methods have also been used, such as fined tubes. Generally the additional cost of construction outweighs the advantages. One addition frequently used is a heat pipe to convey heat from a small burner to a large heat exchanger structure. A heat pipe is a cavity filled with a vaporizable liquid, such as sodium metal and an inert gas. One portion of the cavity is heated, and the liquid vaporized. This is called the evaporation area. The load is located at another portion of the cavity called the condensation area. At the condensation area, the liquid condenses, transferring its heat of evaporation to the load. The result is a conveying of heat with low loss. The use of heat pipes, however, cannot increase the pressure or temperature capabilities.

Finally, baffle arrangements have been tried alone, or in combination with the other methods. The baffles can increase thermal efficiency, but at an increase in construction cost. In summary, no method has been found that provides high thermal efficiency at low cost with the ability to be exposed to constant high temperatures and pressures at controlled flow resistance.

SUMMARY OF THE INVENTION

An improved heat exchanger is provided by the present invention. The device has the ability to transfer heat to or from a stream of fluid with high efficiency and controlled flow resistance. Ability to withstand continuous high temperatures and pressure is achieved at minimal construction cost. Finally, the device is adaptable to mass production methods.

The device is comprised of at least one annular fluid passage that is surrounded on one or both sides by heating walls. the heating walls are constructed of large diameter thinwall tubing to minimize cost and maximize heat transfer. The thin walls are separated by spacers which allow passage of a second fluid which may be a coolant or heat transfer medium, while providing support to the walls. The spacers are designed to be placed under compression by either multiple annular passages, or annular passages and insulation passages, so that no thick walls of high temperature materials are needed. The device is designed so that all components are cylinders of various sizes with the exception of the ends and manifold block. The device is shown as attached to a Stirling cycle engine as a heater, but it is realized that the invention is equally useable in other applications, or as a cooler. A second embodiment is illustrated which includes a single heating wall for lower cost of construction.

DESCRIPTION OF THE PREFERRED EMBODIMENT

Figure 1:
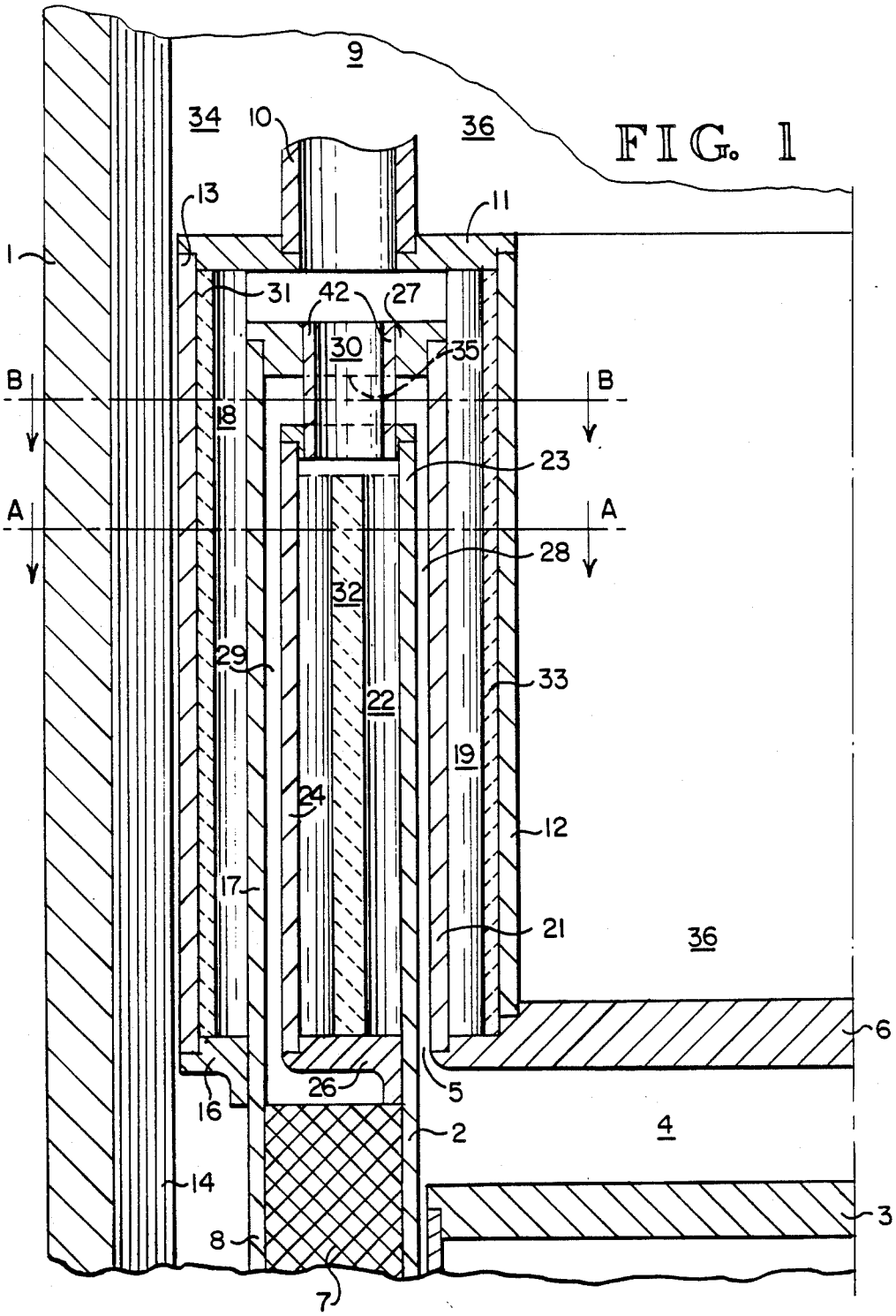
FIG. 1 is a sectional elevation view of the device in a working environment.

FIG. 1 is a sectional elevation view of the device in use as a heater on a Stirling or hot gas engine. This view is a partial sectional view of concentric cylinders and only one side of the assembly is shown for clarity, the other side being identical. As the device is shown attached to an engine, several components of the engine are shown to illustrate the use of the device that are not essential to use of the invention in other heat exchanger applications.

The entire apparatus is enclosed in a pressure shell 1. Pressure shell 1 is of substantial thickness to contain the high pressure fluids within the device and engine. Since pressure shell 1 is not subjected to high temperatures, it may be constructed of any high strength material, such as steel, which has the added advantage of low cost. Within pressure shell 1 is the cylinder 2 of the engine, a displacer 3 oscillates within cylinder 2 of the engine. One end of the cyliner 2 of the engine is constantly exposed to high temperatures and must, therefore, be constructed of a super alloy. Such materials are expensive, but only a thinwall tube is required in this embodiment. The top of cylinder 2 is closed by a cylinder head 6, which, along with cylinder 2 and the top of displacer 3, defines the expansion space 4 of the engine. The only exit from expansion space 4 of the engine is a port 5 which forms the entrance to the heater. Port 5 is shown as an annular opening in this embodiment, but it is realized that equivalent construction, such as holes or slots could be substituted. The exit of the heater is a Regenerator 7. Regenerator 7 is housed between cylinder 2 and an outer wall 8, which is also made of heat resistant material. In operation, gas shuttles between regenerator 7 and expansion space 4, and through the heater under the influence of displacer 3. The purpose of the invention is to transfer heat from an outside source 9 (not shown) to the shuttling gas stream. The device will also work in reverse if the engine is powered by a motor to act as a refrigerator, in which case, heat is transferred from the gas stream to the outside 9.

If the device is used as a heater, outside source 9 is a burner or equivalent heat source, such as radioactive material or solar concentrator. While the preferred embodiments are herein functionally described with reference to heat delivery by means of a heat pipe, it is readily apparent that a pumped heat transfer material, such as a liquid metal, can be substituted for the heat pipe 10 and adjacent structure with minimal modification. Heat source 9 is connected to a heat pipe 10. Heat pipe 10 is a space containing gas and a vaporizable material, such as sodium or potassium metal. Heat source 9 vaporizes the material which then fills heat pipe 10 and areas connected to heat pipe 10. The vaporized material condenses on the walls of such areas, releasing its heat of vaporization to such walls. The above process results in an efficient transfer of heat from source 9 to the walls. Heat pipe 10 enters the device via a hole or annular hole in top plate 11. The junction may be brazed or welded. Top plate 11 forms the top housing of the device and is ring shaped with an inner housing cylinder 12 joined to its inner surface, and a outer housing cylinder 13 joined to its outer surface. The housing cylinders 12, 13 may be joined to top plate 11 by brazing or welding, and are constructed of a high temperature alloy. In this embodiment, inner housing cylinder 12 is joined at its other end to cylinder head 6 by brazing or welding. In another environment a separate flange would replace cylinder head 6. Similarly, outer housing cylinder 13 is attached to the outer regenerator housing 8. Between housing wall 13 and pressure shell 1 is a plurality of layers of multifoil insulation 14. Multifoil insulation 14 is comprised of several layers of heat reflective material, such as nickel separated by layers of an insulating fluid, such as Xenon or carbon dioxide gases. Wall 13 is at a high temperature so insulation is necessary if pressure shell is made of material that cannot be exposed to constant high temperatures. Additionally, if the hot engine gas is operating at high pressure, the counter balancing force of the pressure of insulating gas allows walls 12 and 13 to be constructed of thin wall tubing as there is little pressure differential. This completes the outer housing of the device.

Continuing with FIG. 1 is the internal construction of the device. In this embodiment outer regenerator wall 8 continues into the housing to constitute the outer most heating wall 17 of the device. The annular space 18, between walls 17 and 13, forms the outer annular condenser section of a heat pipe. In this area, during operation, some vapor present in heat pipe 10 condenses, transferring its heat to wall 17. Wall 17 is constructed of thinwall tubing to increase the heat transfer. In a similar manner, an inner condenser section 19 is formed between inner housing wall 12 and an inner heating wall 21. One end of inner heating wall 21 is attached to cylinder head 6 in this embodiment. Finally, a central condenser section 22 is formed between outer central heating wall 24 and inner central heating wall 23. In this embodiment, wall 23 is an extension of cylinder 2 and is joined to wall 24 by a central flange 26. The outer ends of heating walls 23 and 24 are attached to manifold block 27. Walls 21 and 17 are also attached to manifold block 27. Manifold block 27 is sized so that an inner heating area 28 is formed between heating walls 21 and 23, and an outer heating area 29 is formed between heating walls 17 and 24. Communication between the inner heating space 28 and the outer heating space 29 is possible through a passage 35 in manifold block 27. Manifold block 27 also provides several passages 30 for material in heat pipe 10 to enter the central condensing region 22. In summary, it is apparent that all heating walls 17, 21, 23 and 24 are adjacent to condenser regions of the heat pipe 10, therefore, when heat pipe 10 is heated by heat source 9, walls 17, 21, 23 and 24 will rapidly rise to high temperature. All joints are assumed to be connected by welding or brazing, unless otherwise described.

In operation, the fluid pressure in areas 4, 28, 29 and 7 is higher than that in the condenser sections 18, 19 and 22. This pressure differential results in a force tending to collapse the condenser sections. This force is countered by placing spiders 31, 32 and 33 in condenser sections 18, 22 and 19, respectively, and by pressurizing areas 14, 34 and 36 with insulating gas. Spiders 31, 32 and 33 are thus put under compressive stress. Spiders 31 and 33 have passages on the side facing the heating walls 17 and 21 for passage of fluid from heat pipe 10. Inner spider 32 has such passages on both sides. Spiders 31, 32 and 33 can be constructed of any material that is resistant to high temperatures and is strong under compression. Ceramics and glasses are particularly suitable as they can be cheaply molded, but corrugated metal can also be used. In summary, the use of spiders 31, 32 and 33, as integrated into the described heat exchanger, allow low cost construction and high thermal efficiency. These advantages are achieved primarily as a result of allowing thin annular heating walls 17, 21, 23 and 24 by carrying the pressure loads in heating spaces 28 and 29 with the spiders 31, 32 and 33 used in conjunction with pressurized regions 14, 34, and 36.

If used as a heater for a Stirling engine, gas moves through regenerator 7 into outer heating area 29 where the gas is surrounded by heating walls 17 and 24, which heat the gas. The gas then proceeds through the passage 35 in manifold block 27, and into inner heating area 28. In area 28 the gas is surrounded on both sides by heating walls 21 and 23, and is heated further. The hot gas then exits through port 5 into expansion space 4. When displacer 3 moves toward cylinder head 6, the gas returns through port 5 into space 28, 35, then 29, and returns to regenerator 7. From the above description, it is apparent that the device can work in either direction. In addition, if the engine is used as a refrigerator, heat can be extracted from the gas and transferred to a heat sink at 9. It should be noted that the device is normally operated in a position inverted to that shown in FIG. 1, so that condensed fluid in heat pipe 10 returns to the vicinity of heat source by gravity. However, heat pipe operation when oriented as shown, is possible by utilizing metal wicking (not shown), such as wire mesh screens attached to the condensation walls so that capillary action returns the condensate to the heat source 9 through heat pipe 10. Finally, it should be noted that the device can also operate as a cooler, if heat pipe 10 and areas 18, 19 and 22 are filled with a cooling fluid.

Figure 2:
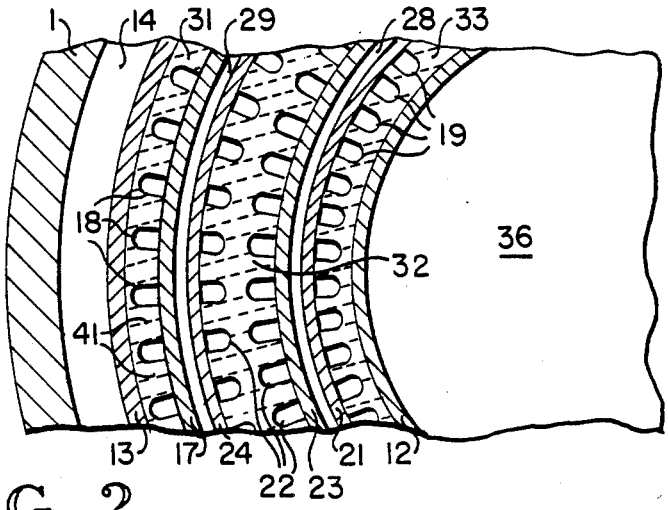
FIG. 2 is a sectional plan view of the FIG. 1 device through line A—A.

FIG. 2 is a plan section view along line A—A of FIG. 1. This figure clearly shows the circular nature of the device, although only a segment of each circle is shown, it being realized that the device is symmetrical. Pressure shell 1 surrounds the device and is filled with high pressure insulation gas in regions 14 and 36. Area 14 may also be filled with multifoil insulation as described above. Next, is outer housing wall 13, which along with outer heating wall 17, defines the outer condensing section of the heat pipe. Spider 31 fits between walls 13 and 17, and provides a plurality of pillars for transmitting compressive forces between walls 13 and 17. The area between pillars 41 forms channels which constitute the condensing section 18 of the heat pipe. The outer heating passage 29 is seen to be an annular section between heating walls 17 and 24. The central condenser section is similar to the outer condenser section except that condensing section passages 22 are formed on both sides of spider 32. It should be noted that spider 32 is designed to provide unbroken pillars between walls 24 and 23. The inner condensing section is formed similar to, but in reverse of, the outer condensing section, with inner heating wall 21, spider 33 and inner housing wall 12. The inner heating area 28 is thus formed between heated walls 21, 23 and is also seen to be an annular space. Finally, the central area 36 of the device is filled with a compressed insulating gas that supports inner housing wall 12 against the compressive forces transmitted to it from inner heating area 28 through heating wall 21 and spider 33.

Figure 3:
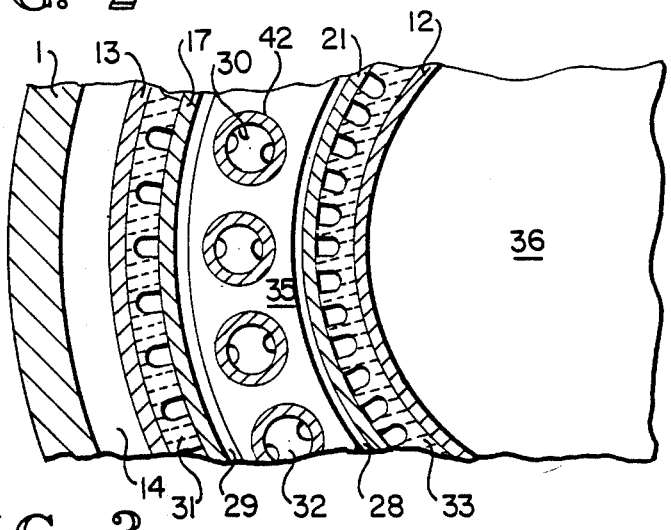
FIG. 3 is a sectional plan view of the FIG. 1 device through line B—B.

FIG. 3 is a sectional plan view of line B—B of FIG. 1. Line B—B passes through the passage 35 between annular heating areas 28 and 29. Parts 1, 14, 13, 31, 17, 29, 28, 21, 33, 12 and 36 are substantially identical to those in FIG. 2. It is apparent that the fluid flows from outer heating passage 29 through area 35 and into inner heating passage 28. Flow in the reverse direction is also possible. It will be seen that passage 35 is formed by the spaces between a series of tubes 42, the interiors of which form passages 30. A portion of the central spider 32 can be seen through passages 30. As passages 30 area is also filled with hot vaporized liquid, additional heat transfer can occur in this cross over region. Tubes 42 must be sufficiently thick to contain the pressure differential between areas 30 and 35, but this is the only high temperature portion of the device that may require thicker walled tubing, although the relatively small diameter of the tubes minimizes this potential problem.

Figure 4:
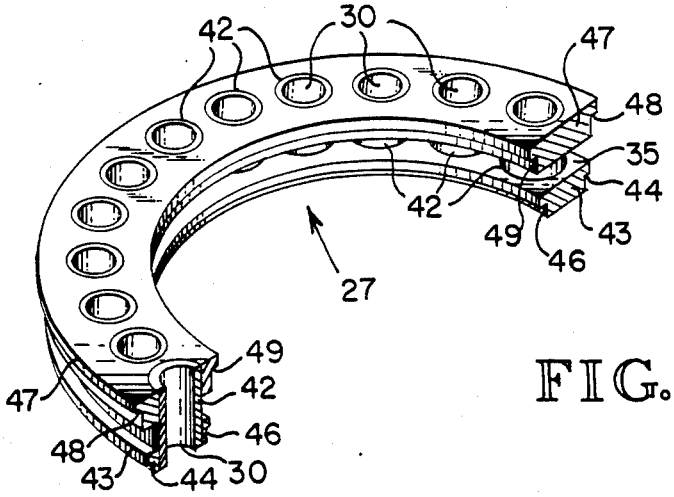
FIG. 4 is a perspective view of the manifold Block of the FIG. 1 device.

FIG. 4 is a detail of the manifold block of the invention. Only half of manifold block 27 is shown to allow view of sections through passages 30 and 35. Manifold block 27 is comprised of a top flange 47, a bottom flange 43, and a series of tubes 42. The interiors of tubes 42 form a passage 30, and the area defined by the top of flange 43, the bottom of flange 47 and the areas between tubes 42 form passage 35. In the construction shown in FIG. 4, flanges 43 and 47 are provided with holes to accept tubes 42. This construction would be used if manifold 27 is constructed by welding. Manifold block 27 could also be made by casting or electroforming, in which case it would be one piece. Lower flange 43 provides an outer surface 44 to accept and join to outer central heating wall 24 and a surface 46 to accept and join to inner central heating wall 23 as shown in FIG. 1. Similarly, top flange 47 provides surfaces 48 and 49 to accept and join to outer heating wall 17 and inner heating wall 21 respectively. The radial distance between surfaces 44 and 48, and between 49 and 46, determine the size of passages 28 and 29. The size of passages 28 and 29 determines the resistance to flow of the device. Manifold block 27 provides a simple means to adjust the flow resistance to a pre-determined value.

Figure 5:
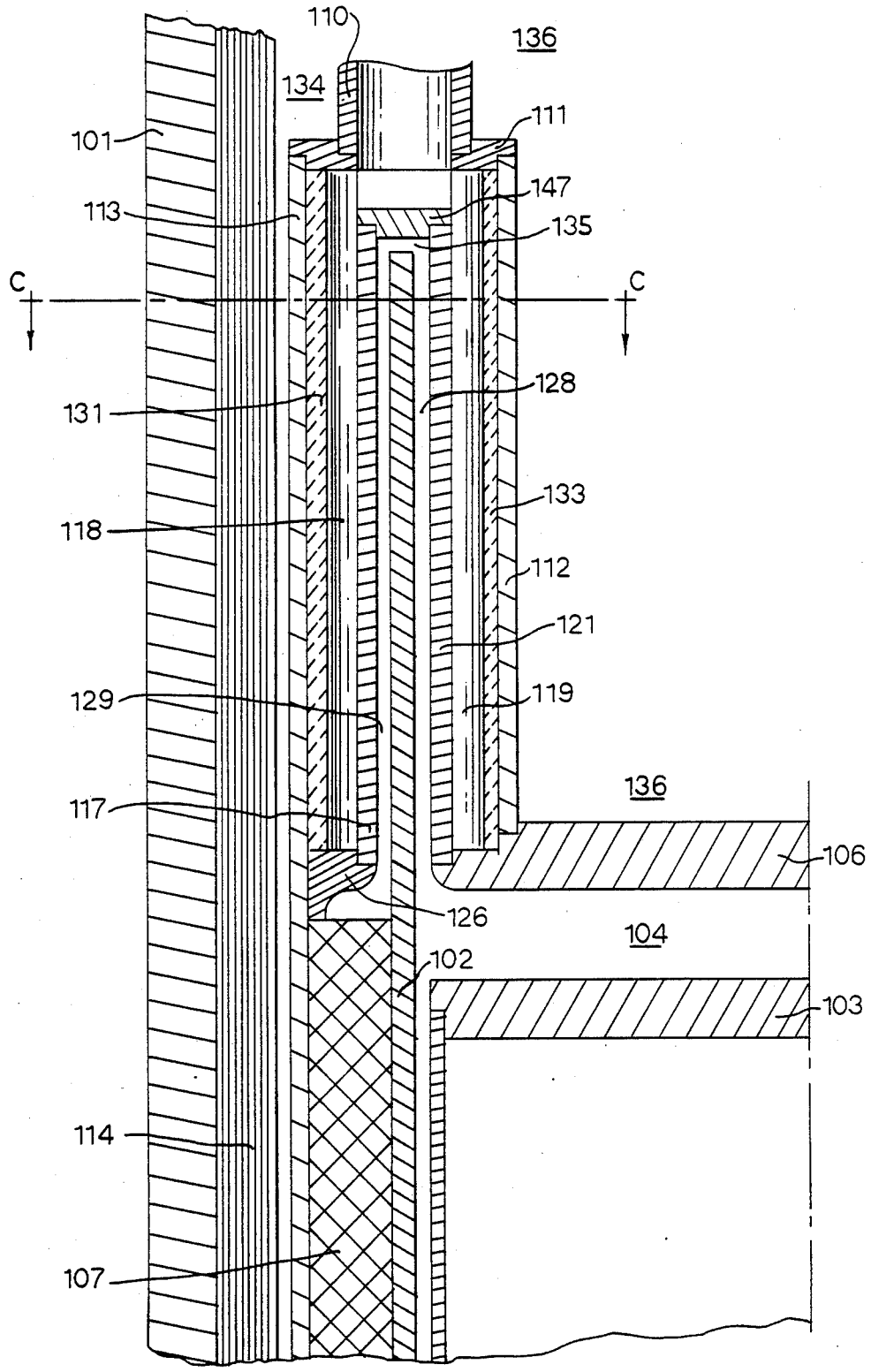
FIG. 5 is a sectional elevation view of a second embodiment of the invention.

FIG. 5 is a section elevation view of a second embodiment of the invention. In this embodiment, the device is surrounded by a pressure wall 101 and insulation 114 in a manner similar to the FIG. 1 embodiment. The device is shown connected to a Stirling engine as in the FIG. 1 embodiment. The regenerator of the engine is shown at 107 and a piston 103 is near the top 106 of cylinder 102. Spaces 114, 134 and 136 are pressurized with insulating gas as in the FIG. 1 embodiment. A heat pipe 110 is connected to a source of high temperature and is filled with a conductive media such as sodium vapor. The conductive media is contained between an outer annular containment wall 113 which also serves as an outer wall for regenerator 107 and an inner annular containment wall 112 which are connected to heat pipe 10 by a top cap 111. A bottom cap 126 seals to outer containment wall 113 and an outer heater wall 117. An inner heater wall 121 is connected to outer heater wall 117 by a heater top cap 147. In this embodiment, inner heater wall 121 and inner containment wall 112 are sealed to cylinder head 106. It is thus apparent that the conductive media area between walls 113 and 117 and caps 126 and 111 is connected to the area between walls 121 and 112 and cap 111 and cylinder top 106. An interior non-heated wall 102 protrudes into the annular space between heater walls 117 and 121 to divide this area into inner and outer annular heat spaces 128 and 129, respectfully. Spaces 128 and 129 are connected by a passage 135. The result is a long path for gases circulating between regenerator 107 and the space 104 between piston 103 and cylinder top 106. Ceramic or metal spacers 131 and 133 between walls 113 and 117 and 121 and 112, respectively, allow heater walls 117 and 121 to be thin for good heat transfer. Spacers 131 and 133 include passages 118 and 119, respectively, for passage of the conductive media.

In use, since the passages 118 and 119 are filled with condensing conductive media, heater walls 117 and 121 are rapidly heated to a temperature similar to that of heat pipe 110. Any gas flowing between regenerator 102 and area 104 must thus pass along the entire length of heating walls 117 and 121 and is thereby heated with high efficiency.

Figure 6:
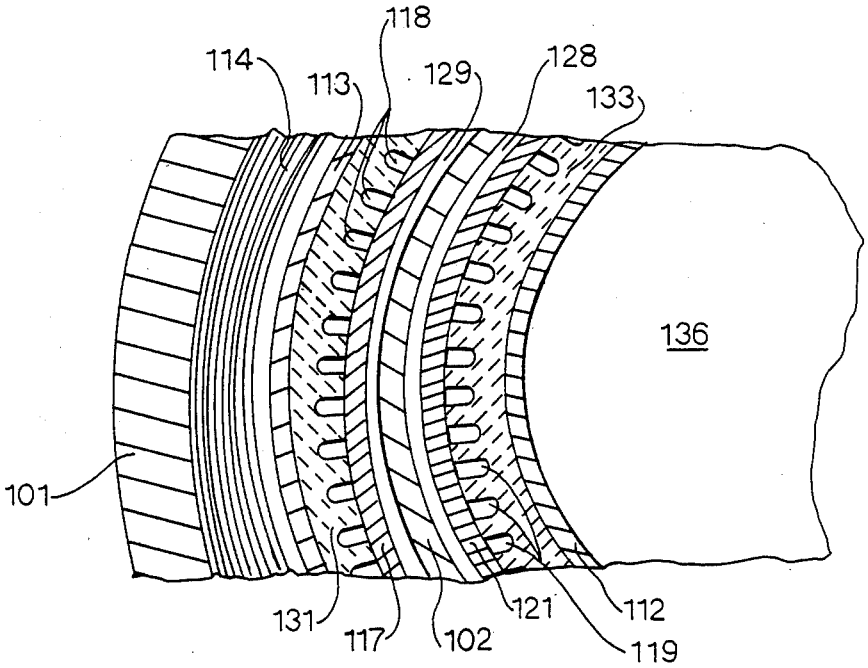
FIG. 6 is a sectional plan view of the FIG. 5 device through line C—C.

FIG. 6 is a partial plan section view along line C—C of FIG. 5. This figure shows the annular nature of the invention. An outer pressure shell 101 surrounds the device. Multifoil insulation 114 filled with pressurized insulating gas is adjacent to shell 101. Outer containment wall 113 and inner containment wall 112 enclose the hot portion of the device and are adjacent to and in contact with ceramic spiders 131 and 133, respectively. Spiders 131 and 133 include passages 118 and 119 for the conductive media. Outer heating wall 117 and inner heating wall 121 also contact spiders 131 and 133. A wall 102 divides the space between heating walls 117 and 121 into two passages 129 and 128. In operation, area 136 and the vicinity of insulator 114 are filled with pressurized insulating gas. Passages 129 and 128 are filled with pressurized working fluid. Since the conductive media in passages 118 and 119 is at a lower relative pressure, spacers 131 and 133 are under constant compressive stress. Use of ceramic for spacers 131 and 133 allows use of thin walls for heater walls 117 and 121 due to its high compressive strength. Other materials having similar characteristics may be substituted for ceramics.

It will be understood that the invention may be embodied in other specific forms without departing from the spirit of the central characteristics thereof. The present examples and embodiments, therefore, are to be considered in all respects as illustrative and not restrictive, and the invention is not to be limited to the details thereof, but may be modified within the scope of the appended claims.

We claim:

1. A heater head for a Stirling engine comprising:

a housing for enclosing the heater head with gas at a substantial elevated pressure; and, insulator means attached to said housing for insulating said heater head; and, inlet means attached to a regenerator in said housing for admission of relatively high pressure working fluid from the regenerator of a Stirling engine; and, a first annular heating wall in said housing attached to said inlet means for heating said working fluid; and, a second annular heating wall in said housing concentric with said first heating wall but of lesser diameter so that an annular space is formed between said first heating wall and said second heating wall for heating working fluid; and, a third heating wall in said housing concentric with and smaller in diameter than said second heating wall forming the condensing area of a heat pipe between said second heating wall and said third heating wall; and, a fourth heating wall in said housing concentric with and smaller in diameter than said third heating wall so that a second annular space is formed between said third heating wall and said fourth heating wall for heating working fluid; and, passage means connecting said annular space between said first and second heating walls to said second annular space between said third and fourth heating walls for allowing flow of working fluid; and, outlet means connected to said second annular space for allowing working fluid to exit into the cylinder of a Stirling engine.

2. A heater head as in claim 1 further comprising:

a spider under compressive stress and having a cavity cavity between said second and said third heating walls for resisting pressure loads from said second and said third wall.

3. A heater head as in claim 2, further comprising a second ceramic spider having a second cavity adjacent said first heating wall and a third ceramic spider having a third cavity; and, an inner housing adjacent to said second and third ceramic spider for forming a fluid tight seal around said heater head.

4. A heater head as in claim 3, wherein said inner housing is adapted for connection to a source of high temperature fluid in such a manner that said high temperature fluid has access to said internal cavity of said first, second and third ceramic spiders.

5. A heater head as in claim 3 wherein said inner housing is the outer wall of a heat pipe.

6. A heater head as in claim 4 wherein said second ceramic spider and said third ceramic spider are under compressive stress when said housing is filled with insulating gas under pressure and working fluid under pressure is in said first annular space and said second annular space.

7. A heater head is in claim 1 wherein said housing is filled with an insulating gas.

8. A heater head as in claim 7 wherein said insulating means is further comprising multifoil insulation between said housing and said inner housing.

9. An improved annular heater head with annular heating walls for use in a Stirling engine using a working fluid receiving heat from a heat source the improvement comprising:

connecting means connecting said heater head to said heat source with a heat pipe having a conducting fluid at a pressure lower than the average pressure of said working fluid; and, enclosing means enclosing said heater head with an insulating gas having pressure comparable to said working fluid; and, supporting means supporting said annular heating walls by providing spiders under compression in the area of the head occupied by conducting fluid adjacent walls which are adjacent to working fluid or insulating gas.

10. An improved annular heater head as in claim 9 wherein there are two of said heating walls and two spiders.

11. An improved annular heater head as in claim 9 wherein there are four (4) of said heating walls and three (3) spiders.

12. An improved annular heater head as in claim 9 wherein said spiders are constructed of a ceramic material.

* * * * *